US006616540B2

(12) United States Patent
Slacum

(10) Patent No.: US 6,616,540 B2
(45) Date of Patent: Sep. 9, 2003

(54) BILLIARD ACCESSORY WITH POWDER DISPENSING AND CUE TIP SHAPING/SCUFFING CAPABILITY

(76) Inventor: Edward G. Slacum, 544 Rita Dr., Odenton, MD (US) 21113

( * ) Notice: Subject to any disclaimer, the term of this patent is extended or adjusted under 35 U.S.C. 154(b) by 0 days.

(21) Appl. No.: 10/101,440

(22) Filed: Mar. 18, 2002

(65) Prior Publication Data

US 2003/0027651 A1 Feb. 6, 2003

Related U.S. Application Data

(60) Provisional application No. 60/277,354, filed on Mar. 20, 2001.

(51) Int. Cl.[7] ..... A63D 15/16; A45D 33/02; B05B 11/00

(52) U.S. Cl. ..... 473/36; 473/37; 222/634; 132/298

(58) Field of Search ..... 473/35–39, 1; 132/298, 299; 222/162; 224/250; 451/552

(56) References Cited

U.S. PATENT DOCUMENTS

| | | | | | |
|---|---|---|---|---|---|
| 737,226 | A | * | 8/1903 | Guese | 473/37 |
| 1,103,852 | A | * | 7/1914 | Tillou | 473/37 |
| 1,334,724 | A | * | 3/1920 | Tyler | 473/38 |
| 2,685,387 | A | * | 8/1954 | Ganay | 222/634 |
| 3,729,011 | A | * | 4/1973 | Gleicher | 132/298 |
| 3,843,120 | A | * | 10/1974 | Ricci | 473/2 |
| 3,963,237 | A | * | 6/1976 | Bushberger | 473/37 |
| 4,785,586 | A | * | 11/1988 | Kratfel | 451/552 |
| 5,104,122 | A | * | 4/1992 | Gossman | 473/1 |
| 5,129,187 | A | * | 7/1992 | Cain | 473/35 |
| 5,228,160 | A | * | 7/1993 | Porper | 451/552 |
| 5,545,093 | A | * | 8/1996 | Contestabile et al. | 473/36 |
| 5,697,852 | A | * | 12/1997 | Adelson et al. | 473/36 |
| 5,865,682 | A | * | 2/1999 | Sutton | 473/37 |
| 6,226,825 | B1 | * | 5/2001 | Method | 473/1 |

* cited by examiner

*Primary Examiner*—Paul T. Sewell
*Assistant Examiner*—Mitra Aryanpour
(74) *Attorney, Agent, or Firm*—Royal W. Craig

(57) ABSTRACT

An improved means for dispensing powder and shaping/scuffing the tip of a billiard cue, for use during a game of billiards, is herein disclosed. The design of the compact, substantially cylindrical device incorporates the combination of portability, functionality, user discretion, and neatness/convenience of use lacking in the prior art. The device provides a simple, yet reliable means of dispensing small, easily controlled amounts of powder onto the hands of billiard players via the use of a ball and spring assembly. The device allows the user to dispense/apply the powder by (1) compressing the assembly and "rolling" the powder, or (2) "tapping" the ball and spring assembly on the appropriate area of the hand(s). The present invention is a device that also includes a shaping/scuffing tool, on the end opposite the ball and spring assembly, that allows an individual to manicure the tip of a billiard cue. The shaping/scuffing tool consists of an abrasive element positioned in a concave recess at the end of the device. The abrasive element is replaceable/interchangeable.

10 Claims, 5 Drawing Sheets

BILLIARD ACCESSORY WITH POWDER DISPENSING AND CUE TIP SHAPING/SCUFFING CAPABILITY

CROSS-REFERENCE TO RELATED APPLICATIONS

The present application derives priority from U.S. provisional application No. 60/277,354, filed Mar. 20, 2001.

BACKGROUND OF THE INVENTION

1. Field of the Invention

The present invention relates to the game of billiards and, more specifically, to a device utilized by participants while playing the game. In particular, the present invention relates to a combination device used to optimize the condition of the hands of the participants and the tip of the billiard cue during the course of the game.

2. Description of the Background

It is extremely important for an individual participating in a serious game of billiards to have dry hands. Moisture on a player's bridge hand creates too much friction with the billiard cue. This condition creates an un-smooth stroke as the player makes a shot. Moisture on the hands will also, over time, cause a smooth billiard cue shaft to become dirty and tacky. Therefore, a convenient means of dispensing powder onto the hands of a participant during a game is imperative.

Likewise, a device for an individual to scuff and/or shape the leather billiard cue tip during the course of a game is also imperative. Billiard cue tips are generally leather and, through normal use, will lose their shape and ability to retain chalk. Means to scuff and/or shape a billiard cue tip allows the player to form the tip to their liking, thus increasing confidence and shot accuracy. The scuffing process also allows the tip to retain chalk. Chalk is needed on the leather tip to increase the friction at the moment of contact between the tip and the billiard ball. Without the friction provided by the chalk, the ball when struck may (1) not react normally, (2) go off the intended line, or (3) result in a miscue. Any one of these occurrences might cause a player to miss the intended shot.

Others have attempted to address these two requirements through multi-purpose tools and/or devices. U.S. Pat. No. 3,963,237 to Bushberger, U.S. Pat. No. 5,865,682 to Sutton, and U.S. Pat. No. 5,545,093 to Contestabile et al. each disclose a tool/device with means to (1) dispense powder onto the hands and (2) shape/manicure the leather cue tip while playing billiards. However, these devices are not necessarily simple in design and/or not easy to make use of during a game of billiards.

U.S. Pat. No. 3,963,237 to Bushberger discloses a hand-held unit that carries a cue chalk cube and includes a power source for oscillating the cue chalk cube in a substantially rectilinear path. On the other end of the hand-held unit from the cue chalk cube is situated a talcum powder dispenser. A file for dressing the cue tip is attached to the outside of the unit.

This unit requires additional user manipulation to facilitate the powder dispensing process. Specifically, a cap must be rotated in order to align external chamber perforations with internal chamber perforations to allow the powder to be dispensed. This action is not convenient for the user because two hands are required. Furthermore, shaking the device is required to get powder from it. Shaking the unit makes for a messy and inconsistent dispensing action for the powder and leads to waste via its dispersion into the air.

U.S. Pat. No. 5,865,682 to Sutton discloses a device for conditioning the tip of a pool cue that includes a hand-held housing containing a motor and two or more separate tip conditioning mechanisms separately powered by the motor. The pool cue can be inserted into one opening in the housing for subjecting the cue tip to a scuffing action. The pool cue can be inserted into a second opening in the housing in order to apply chalk to the cue tip surface. Preferably the housing contains a powder dispenser for supplying moisture-absorbing powder to the hands of the pool player As with the Bushberger '237 device, this unit also requires additional user manipulation to facilitate the powder dispensing process. The small powder dispenser, located at one end of the housing, is operated by the user manually depressing a disc-like valve which opens two small openings and allows the powder to be gravitationally dispensed. This method of application does not allow the user to control powder dispensing/dispersion and requires two hands (i.e. one to hold the device and the other to operate the valve).

The Bushberger '237 and Sutton '682 devices incorporate motorized mechanisms to shape/scuff the tip of a billiard cue. They both also include a motorized means for applying chalk to the tip. Motorized devices can be unreliable, require maintenance (i.e. battery replacement), and do not provide the user with discretion concerning the shape of the tip. Additionally, the shaping/scuffing action is not visible to the user while the motorized device is being operated. The ability to observe the in-process shaping/scuffing action is essential. The shape of a billiard cue tip can vary significantly and is dependent upon the individual's playing preferences (e.g. a rounded tip vs. a flatter tip). This preference will also vary based on the type of tip being shaped/scuffed (e.g. hard, medium, or soft).

U.S. Pat. No. 5,545,093 to Contestabile et al. discloses a compact billiard accessory that has a generally cylindrical first and second housing which are selectively connectable. The first housing includes a first concave, abrasive surface located adjacent to a first annular end surface of the housing for scraping a cue stick tip, and a second concave, abrasive surface located adjacent to an opposed annular end surface of the housing for shaping the tip. The second housing has a cap with a hole in its surface at one end of the housing that can be rotated to align the hole with a hole in the second end surface of the housing for forming a channel to a refillable talc chamber in the housing. A cue chalk holder fits in the first end of the second housing. When not in use, the first and second housings can be connected to form a compact billiard accessory for clean and convenient storage.

With this device, the dispensing of the powder is achieved by the user aligning holes at one end of the chamber with holes at its opposite end. This action, combined with the shaking required to dispense the powder, is inconvenient as noted in the discussions regarding Bushberger '237 and Sutton '682. Additionally, the multiple means for shaping/scuffing the billiard cue tip require the user to remove and exchange parts at one end of the device in order to obtain the chosen function.

The issues outlined above are obvious to one with ordinary skill in the art. A compact, multi-purpose device designed to solve the aforementioned problems is not known to exist. It would, therefore, be advantageous to provide a device possessing the ability to (1) neatly and reliably apply powder to the hands as a means of absorbing moisture and reducing friction and (2) shape/scuff (i.e. manicure) the tip of a billiard cue to match the preferences of the individual.

SUMMARY OF THE INVENTION

It is, therefore, the primary objective of the present invention to provide a compact, multi-purpose device, for use during a game of billiards, designed to neatly and reliably apply powder to the hands and to shape/scuff the tip of a billiard cue to match the preferences of the individual.

It is another objective of the present invention to provide a compact, multi-purpose device, for use during a game of billiards, that can be easily manipulated to neatly dispense a small, controlled amount of powder onto an individual's hands from a refillable chamber.

It is another objective of the present invention to provide a compact, multi-purpose device, for use during a game of billiards, that allows an individual full discretion as to the amount of powder to be dispensed onto the hands by providing two dispensing techniques, either "tapping" or "rolling" the device.

It is still another objective of the present invention to provide a compact, multi-purpose device, for use during a game of billiards, that can be refilled with powder easily and function properly regardless of whether the powder chamber is full or almost empty.

It is yet another objective of the present invention to provide a compact, multi-purpose device, for use during a game of billiards, that incorporates a replaceable shaping/scuffing element allowing an individual to replace a worn element or to change the degree of "roughness" of the element to suit the user's preferences.

It is still a further objective of the present invention to provide a compact, multi-purpose device, for use during a game of billiards, that is simple in design and low in maintenance, yet able to perform the functions outlined above consistently and without fail.

It is yet another objective of the present invention to provide a compact, multi-purpose device, for use during a game of billiards, that can be comfortably carried in an individual's pocket or billiard cue carrying case.

In accordance with the above objects, an improved billiard accessory with combination powder dispensing and cue tip shaping/scuffing capabilities, for use during a game of billiards, is represented by a compact, substantially cylindrical device. The design of the device incorporates the combination of portability, functionality, user discretion, and neatness/convenience of use lacking in the prior art. The device provides a simple, yet reliable means of dispensing small, easily controlled amounts of powder onto the hands of billiard players via the use of a ball and spring assembly. The dispensing of the powder is accomplished using only one hand and without the need for shaking the device. The device allows the user to dispense/apply the powder by (1) compressing the assembly and "rolling" the powder, or (2) "tapping" the ball and spring assembly on the appropriate area of the hand(s). A friction fit, removable cap is provided to cover the ball and spring assembly to prevent the unintended dispensing of powder in an individual's pocket or billiard cue carrying case during periods of non-use.

The present invention is a device that also includes a shaping/scuffing tool, on the end opposite the ball and spring assembly, that allows an individual to manicure the tip of a billiard cue. The shaping/scuffing tool consists of an abrasive element positioned in a concave recess at the end of the device. The abrasive element is replaceable/interchangeable.

The degree of "roughness" and durability inherent in the shaping/scuffing element is variable depending on the type of billiard cue tip (i.e. hard, medium, or soft) utilized by an individual. For example, if an individual uses a hard, layered tip, he/she may want to use a rougher element to shape that type of tip. Conversely, if a soft tip is preferred, a smoother element can be installed in the concave recess. The process of shaping/scuffing the tip of a billiard cue is performed manually, thus allowing the individual to directly observe and control the shaping/scuffing action. This prevents over scuffing and/or removal of too much of the tip.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
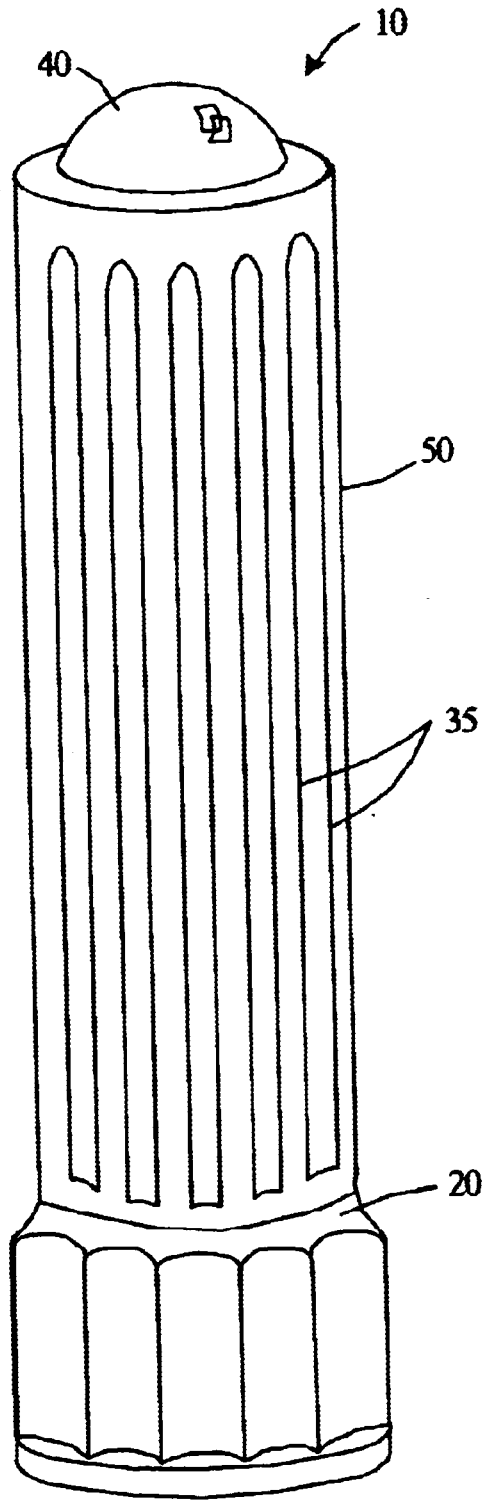
FIG. 1 is a side perspective view of the billiard accessory 10 with powder dispensing and cue tip shaping/scuffing capabilities according to a first embodiment of the present invention.

FIG. 1 is an elevation perspective view of the billiard accessory 10 with powder dispensing and cue tip shaping/scuffing capabilities according to a first embodiment of the present invention.

The billiard accessory 10 generally includes a cylindrical powder chamber 50, powder dispensing ball 40, and a tension spring cap 20. The chamber 50 and cap 20 are preferably fabricated of aluminum. However, these items can be made from any material similar in weight and machineability to aluminum. The ball 40 is preferably fabricated of Nylon as opposed to steel because a Nylon ball has a lower coefficient of friction, seats more snugly, and rotates more easily. However, a steel ball or other material will also suffice. Approximately one-third of the surface area of the ball 40 protrudes out of the chamber 50. Preferably, the exterior surface of the powder chamber is defined by ribs 35 for a better grip.

Figure 2:
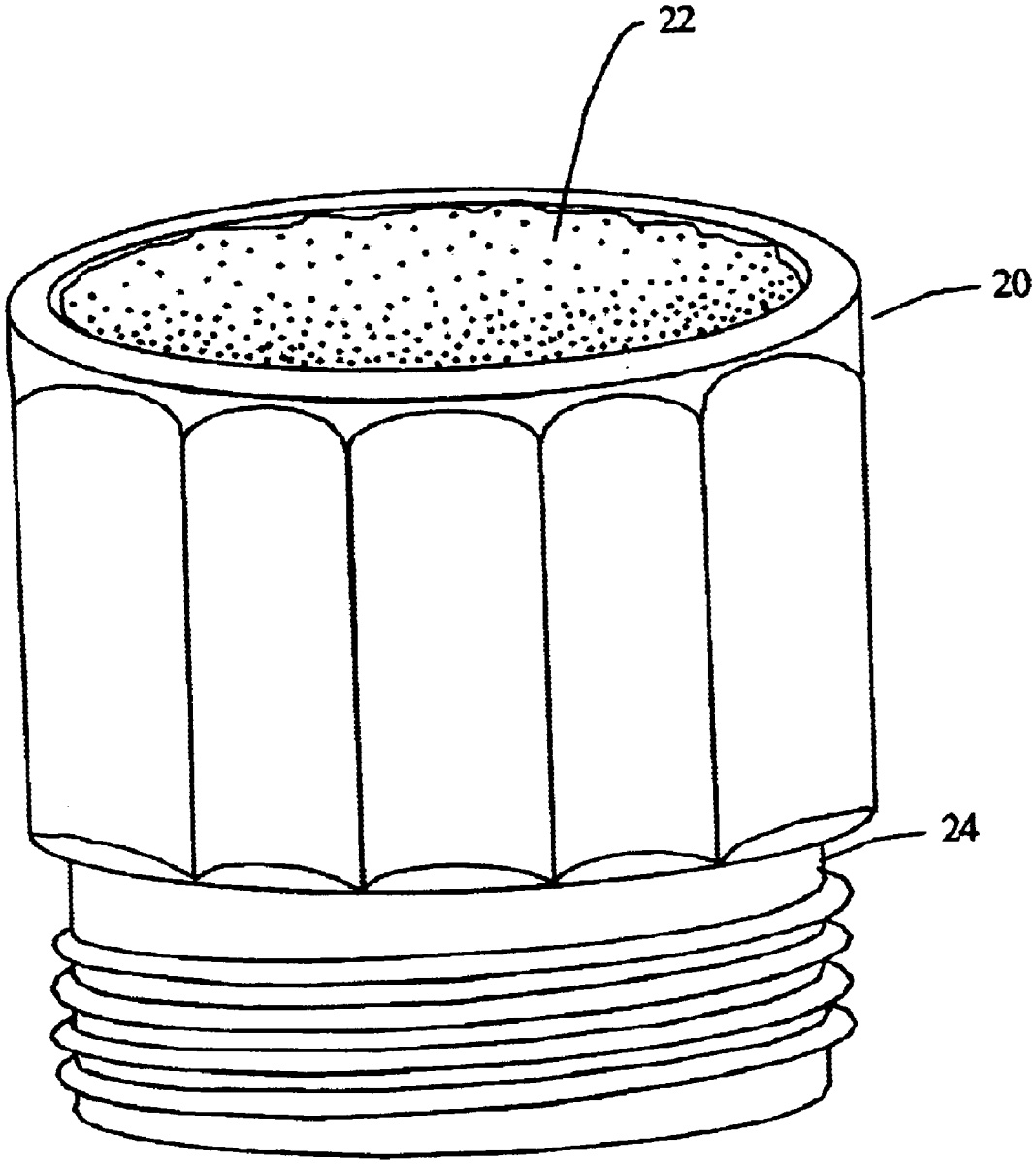
FIG. 2 is a side perspective view of the threaded, tension spring cap 20 as in FIG. 1 with abrasive element 22.

FIG. 2 is an elevation perspective view of the threaded, tension spring cap 20 with abrasive element 22 and threaded undercut 24 according to the present invention. The tension spring cap 20 screws into the cylindrical powder chamber of FIG. 1. Preferably, the exterior surface of the cap 20 is knurled as shown for ease of screw-threading into/from the powder chamber 50. The distal end of the cap 20, that which is located beneath threaded undercut 24, resides inside the powder chamber 50 when the billiard accessory is fully assembled, and is a substantially flat surface. This provides a stable seating surface for the tension spring 30 (see FIG. 6).

The opposing end of the cap 20 is concave to seat abrasive element 22 and to conform to the tip of a billiard cue. The concave cavity holds the abrasive element 22 that is used to shape/scuff the tip of the billiard cue. The abrasive element 22 is preferably a small piece of sandpaper bonded by conventional glue inside the recess formed by the concave end of the cap 20, and it is preferred that the glue be contact cement or the like so that the abrasive element 22 can be readily replaced/exchanged. The cap 20 is designed to accept sandpaper of varying coarseness/roughness. This allows the user to customize the usefulness of the billiard accessory 10 depending on his/her preferences. Use of this aspect of the present invention requires only that the abrasive element 22 be brought into contact with the billiard cue tip. The amount of force (e.g. minimal, significant) then applied to the tip, for the purpose of shaping/scuffing it (i.e. allowing it to hold chalk more effectively), is user-defined.

Figure 3:
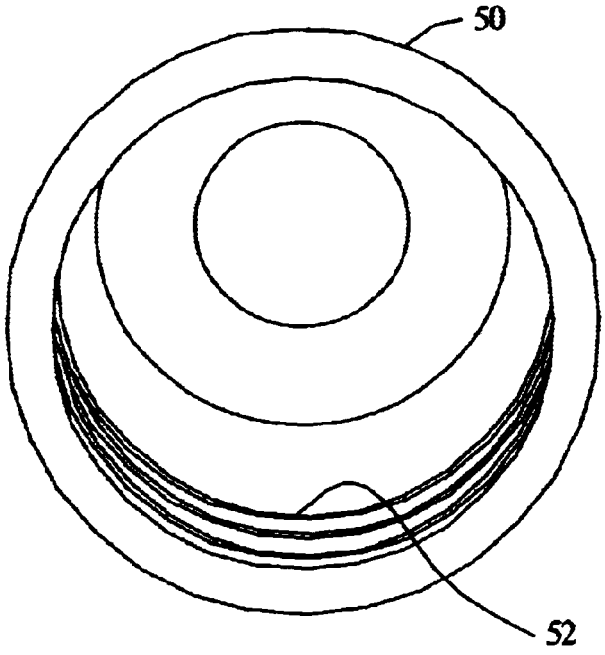
FIG. 3 is an end perspective view of the cylindrical powder chamber 50 as in FIG. 1 with tension spring cap end in foreground, powder dispensing ball end in background, and showing the taper within the chamber 50.
Figure 4:
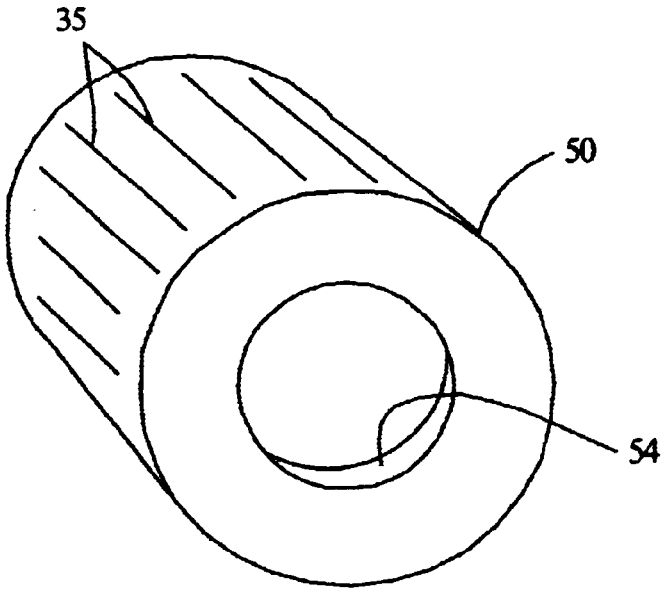
FIG. 4 is an end perspective view of the cylindrical powder chamber 50 (powder dispensing ball end in foreground) as in FIGS. 1 and 3.

FIGS. 3 and 4 show end perspective views of the cylindrical powder chamber 50 according to a first embodiment of the present invention. The tension spring cap end is shown in the foreground of FIG. 3, the powder dispensing ball end is observed in the foreground of FIG. 4. These Figures show the internal surfaces of the powder chamber 50 where the inside diameter varies as needed to house the dispensing ball 40 and tension spring 30 (see FIG. 6). The internal threads 52 that accept the threaded end of the tension spring cap 20 (see FIG. 2) are seen in the foreground of FIG. 3. It is through this orifice, with the tension spring cap removed, that the chamber 50 is refilled with powder on an as needed basis. The spring 30 remains inside of the chamber 50 as the powder is poured in.

The dispensing ball end of the chamber 50, shown in FIG. 4, contains a seating surface 54 that is configured to retain the majority of the ball 40 (approximately two-thirds of its surface area, see FIG. 6) within the chamber 50. The remaining surface area of the ball 40 protrudes out of the chamber 50 in order to deliver powder, on demand, to the hands of the user. The fit between the ball 40 and the seating surface 54 must be leak-proof to prevent any inadvertent dispensing of the powder, and it must allow the ball 40 to roll smoothly during the powder application process.

Figure 5:
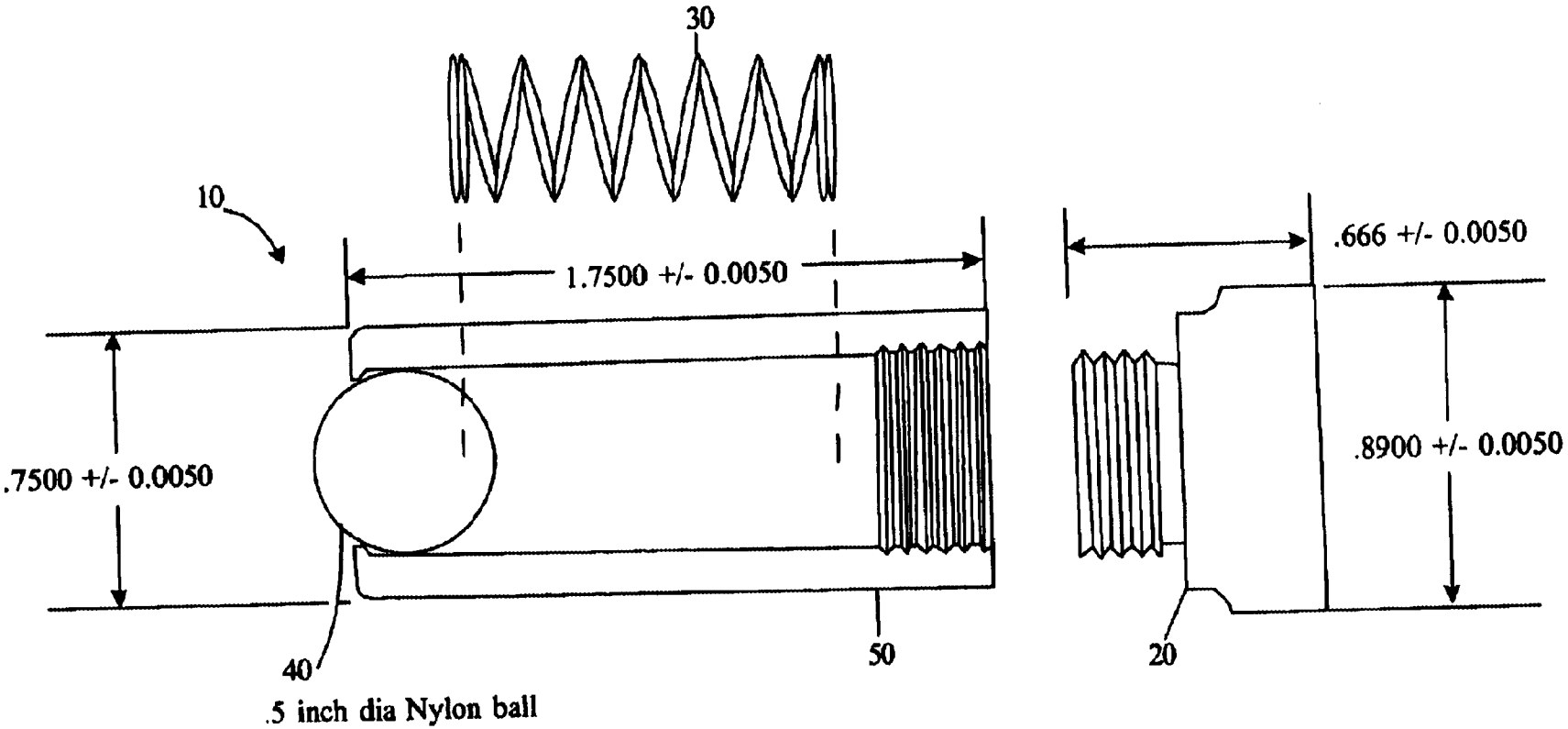
FIG. 5 is an exploded view of the billiard accessory 10 as in FIG. 1 showing the relative positions and dimensions of the tension spring cap 20, the tension spring 30, the powder dispensing ball 40, and the cylindrical powder chamber 50.
Figure 6:
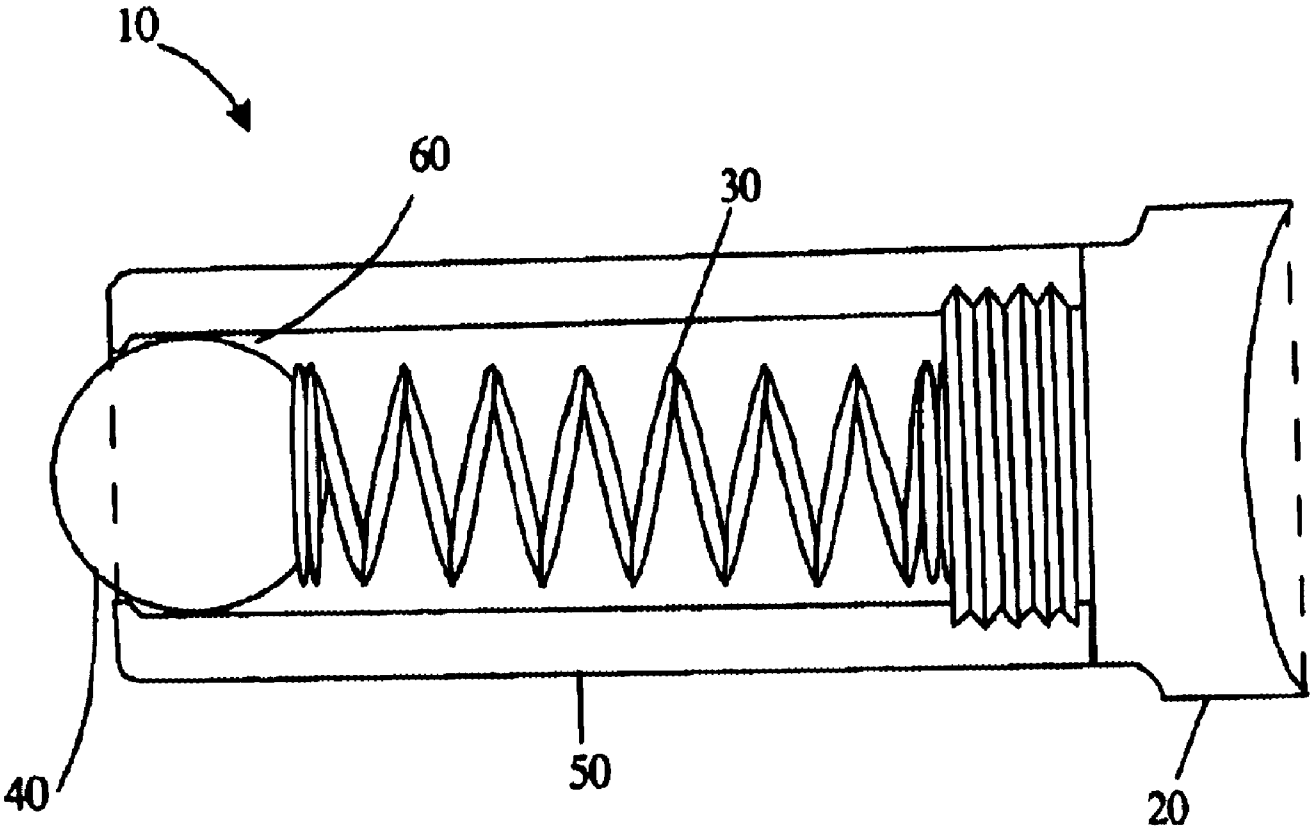
FIG. 6 is a cross-sectional view of the billiard accessory 10 as in FIGS. 1 and 5.

FIG. 5 is an exploded view of the billiard accessory 10 according to a first embodiment of the present invention showing the relative positions of the tension spring cap 20, the tension spring 30, the powder dispensing ball 40, and the cylindrical powder chamber 50. FIG. 6 is a cross-sectional view of the billiard accessory 10 shown fully assembled.

The ball 40 is placed within the powder chamber 50 where it seats on the appropriately configured seating surface 54 (see FIG. 4) located at the dispensing end. Next, the tension spring 30, preferably fabricated of steel, is inserted such that one end rests against the ball 40. After the chamber 50 is filled with an appropriate amount of powder, the tension spring cap 20 is secured in position via the internal threads 52 (see FIG. 3). The assembly of the cap 20 and the chamber 50 serves to keep the tension spring 30, whose outside diameter is slightly smaller than the inside diameter of the chamber 50, properly aligned in order to exert the appropriate amount of force on the ball 40. The precise fit between the powder chamber 50 and the cap 20 required to maintain a consistent, repeatable amount of spring force, despite numerous disassembly/reassembly cycles to refill the billiard accessory 10, is facilitated by the undercut 24 shown in FIG. 2.

The design of the tension spring 30 addresses two goals. First, it must be sized to prevent the escape of powder from the chamber 50 when the billiard accessory 10 is at rest, or not being used. A suitable set of exemplary dimensions are shown in FIG. 5. Second, the force created by the spring 30 must be such that the dispensing ball 40 can be depressed by the user with a comfortable amount of effort.

Another optional component of the present invention is a rubber or plastic cap (not shown in the Figures) designed for installation over the dispensing ball end of the accessory 10. The use of this component ensures that, regardless of the circumstances or manner in which the accessory 10 is carried (i.e. pocket or billiard cue case), powder would not be dispensed as a result of inadvertent pressure on the ball 40.

A radial orifice 60 is created by the difference in the diameters of the ball 40 and the inside of the chamber 50. When the protruding portion of the dispensing ball 40 is pressed onto the user's hand(s), the ball 40 is forced backward/upward into the powder chamber 50. This action "opens" the orifice 60 and allows powder to flow onto the user's hand(s). There are two different powder dispensing techniques that can be used with the present invention. The first technique requires the user, while holding the device in one hand, to "tap" the dispensing ball 40 onto the other hand. As described above, this action moves the ball 40 off of the seating surface 54 (see FIG. 4) allowing powder to flow through the orifice 60. The tapping motion momentarily displaces the ball 40 and controllably releases an amount of the powder.

In the second technique, the user presses the dispensing ball 40 onto the other hand and simultaneously "rolls" the ball 40 across the surface of the skin to dispense the powder. Rolling also provides a measured amount of flow control of the powder because the powder momentarily clings to the ball 40 and rolls past the seating surface and outward through the orifice 60 for direct application. Neither of the aforesaid techniques requires the billiard accessory 10 to be shaken.

Any form of moisture absorbing agent (e.g. baby powder, talcum powder) will, with the passage of time, have a natural tendency to become compacted within the cylindrical chamber 50. The design of the present invention addresses this eventuality. The tension spring 30, during a typical powder dispensing cycle, acts as an agitator within the cylindrical chamber 50. When the ball 40 is pressed, the spring 30 is compressed and moves within the powder held in the chamber 50. The movement of the spring is sufficient to disrupt the compacting process and keep the powder flowing as required.

It is worth noting that the powder dispensing aspect of the present invention can be adapted for operation with a wide range of "chamber" sizes to accommodate other applications where the controlled dispensing of powder is required. The configuration of the inside of the powder chamber, the size of the dispensing ball, and the force supplied by the spring can be varied to generate many different hand-held devices for this purpose.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. A billiard accessory having powder dispensing and cue tip shaping/scuffing capabilities, comprising:

a cylindrical powder chamber for holding an amount of a dry, granular material, said powder chamber having a constricted orifice at one end;

a powder dispensing ball seated inside said powder chamber against said constricted orifice;

a tension spring for biasing said ball against said constricted orifice and thereby providing a measured amount of flow control of said powder about said ball and outward through said orifice at user-defined intervals;

a cap secured to another end of said powder chamber for containing said powder dispensing ball and tension spring therein, said cap having an outwardly-disposed concave face lined with abrasive for use in shaping/scuffing the tip of a billiard cue.

2. The billiard accessory according to claim 1, wherein approximately one-third the surface area of said powder dispensing ball protrudes outwardly from said cylindrical powder chamber through the constricted orifice.

3. The billiard accessory according to claim 1, said powder dispensing ball is Nylon.

4. The billiard accessory according to claim 1, wherein the abrasive in said cap further comprises an abrasive element mounted in the concave face.

5. The billiard accessory according to claim 1, wherein the powder dispensing ball and tension spring provide a measured amount of flow control of said powder upon said user tapping said ball, said tapping motion serving to momentarily displace the ball to controllably release an amount of the powder.

6. The billiard accessory according to claim 1, wherein the powder dispensing ball and tension spring provide a measured amount of flow control of said powder upon said user rolling said ball on a surface, whereby said powder momentarily clings to said ball outward through said orifice until application to at user-defined intervals to controllably release an amount of the powder to said surface.

7. The billiard accessory according to claim 1, wherein the tension spring when compressed and decompressed acts as an agitator within the powder chamber to prevent said powder from compacting.

8. The billiard accessory according to claim 1, wherein said cap is screw-threaded into said powder chamber.

9. The billiard accessory according to claim 1, wherein the exterior surface of said powder chamber is defined by ribs for a better grip.

10. The billiard accessory according to claim 8, wherein an exterior surface of said cap is knurled for ease of screw-threading into/from said powder chamber.

* * * * *